United States Patent [19]

Cerutti

[11] Patent Number: 4,536,978

[45] Date of Patent: Aug. 27, 1985

[54] STEAM IRONING APPLIANCE

[76] Inventor: Rosanna Cerutti, Via degli Odescalchi 15, Milan, 20148

[21] Appl. No.: 573,681

[22] Filed: Jan. 25, 1984

[30] Foreign Application Priority Data

Feb. 7, 1983 [IT] Italy ..... 20706/83[U]

[51] Int. Cl.[3] ..... D06F 81/08

[52] U.S. Cl. ..... 38/103; 38/77.6

[58] Field of Search ..... 248/631, 642; 108/136; 38/103, 88, 94, 77.6 T

[56] References Cited

U.S. PATENT DOCUMENTS

| | | | |
|---|---|---|---|
| 1,536,637 | 5/1925 | Thurnauer . | |
| 2,310,555 | 2/1943 | Steele | 38/103 |
| 2,450,092 | 9/1948 | Reichold . | |
| 2,637,192 | 5/1953 | Richterkessing . | |
| 2,661,552 | 12/1953 | Reichold . | |
| 3,107,073 | 10/1963 | Monroe | 248/642 |
| 3,966,182 | 6/1976 | Stadelmann et al. | 248/631 X |

FOREIGN PATENT DOCUMENTS

| | | | |
|---|---|---|---|
| 256849 | 2/1913 | Fed. Rep. of Germany . | |
| 2414001 | 10/1975 | Fed. Rep. of Germany . | |
| 2552778 | 12/1976 | Fed. Rep. of Germany | 38/103 |
| 2461773 | 2/1981 | France . | |
| 246634 | 10/1947 | Switzerland . | |
| 1037354 | 7/1966 | United Kingdom . | |
| 1519356 | 7/1978 | United Kingdom . | |
| 2005731 | 4/1979 | United Kingdom . | |

*Primary Examiner*—Werner H. Schroeder
*Assistant Examiner*—Andrew M. Falik
*Attorney, Agent, or Firm*—Wenderoth, Lind & Ponack

[57] ABSTRACT

A steam ironing machine includes an ironing board, a steam generator to convey steam to a steam iron, a heater for the ironing board, a suction device to remove residual moisture from ironed clothes. The ironing board is rotatably mounted by hinges with respect to a support element between two positions, i.e. a work position where the board is horizontally disposed and a rest position where the board is vertically disposed. The ironing board rotates from the work position to the rest position with the board tip directed toward and adjacent the support. Rotational movement of the ironing board in both directions is controlled by shock absorbers which aid the operator in achieving this rotation movement and at the same time absorb stresses resulting from this rotational movement.

11 Claims, 10 Drawing Figures

STEAM IRONING APPLIANCE

BACKGROUND OF THE INVENTION

1. Field of the Invention

This invention relates generally to steam ironing machines and particularly to a steam ironing household appliance.

2. Description of the Prior Art

There are known steam irons which are provided with means capable of delivering a steam flow at a suitable temperature during the ironing of clothes or the like placed on an associated board, the steam flowing out through a plurality of holes provided in the ironing plate. The delivered steam is obviously in direct contact with the cloth to be ironed, which simultaneously is subjected both to the pressing and sliding action exerted by the smooth working surface of the steam iron and to the wetting and heating action exerted by the steam. In a sense, this situation has been recommended since conventional cloth ironing requires wetting of the clothes before the steam iron is pressed over the clothes, so that the ironing operation can be better and easily performed. However, this conventional ironing operation has the disadvantage that, once the clothes are ironed, they generally retain a certain amount of moisture, with the result that after the ironing operation the clothes undergo so-called "recovery", with the result that the ironing does not turn out very well. The clothes partially recover their initial configuration so that the creases and folds that the ironing operation was intended to relieve are reformed, of course to a lesser extent.

It is apparent that in this conventional ironing operation was lacking with regard to drying of the ironed clothes. Therefore, industrial or commercial type ironing machines have been proposed to permit the full drying of the ironed clothes after steam ironing by means of suction removal of the residual moisture. These machines are very heavy and cumbersome since they present a rigid assembly comprising the ironing board and the associated means, such as the base, the steam generator and the aspirator. These machines usually are used in laundries and dry cleaning shops. Conversely, the conventional appliances for household ironing, while being provided with steam capability in addition to the conventional electric ironing capability, cannot perform drying by suction of the residual moisture in the clothes.

SUMMARY OF THE INVENTION

The object of the present invention is to provide a machine, apparatus or the like which combines the features of a household appliance, and which therefore can be easily used in areas of small dimensions, with the advantages of industrial or commercial ironing machines.

This object is achieved by providing a steam ironing machine for clothes, garments, shirts and the like, in the form of a structure including an ironing board directly or indirectly cooperating with means adapted to generate steam to be conveyed to a steam iron. The ironing board is provided with steam means as well as with suction means adapted to remove residual moisture from the ironed clothes. The ironing board is rotatably mounted by hinging means with respect to an appliance support element so as to be movable to two main positions, namely a work position where the board is horizontally disposed and the rest position where the board is vertically disposed. The ironing board rotates from the work position to the rest position with the board tip directed toward and adjacent to the support base. The rotational movement of the ironing board, both in this direction and in a reverse direction, is controlled by shock absorbing means, preferably in the form of gas springs, which enable the operator to carry out this rotational movement with a minimum of effort in both directions and at the same time absorb the stresses deriving from this rotational movement.

DESCRIPTION OF THE PREFERRED EMBODIMENT

Figure 1A:
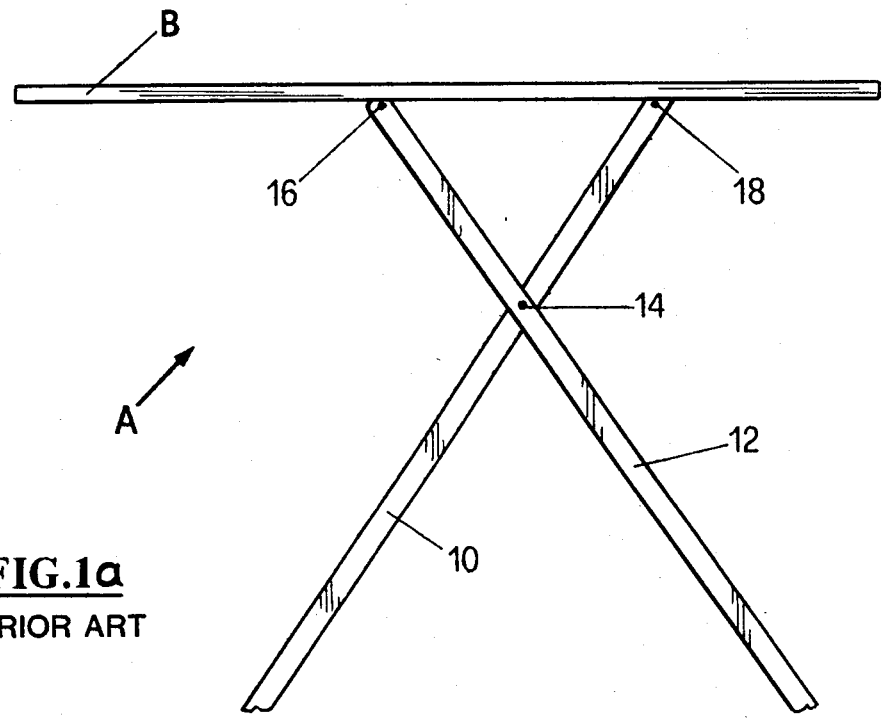
FIG.1a PRIOR ART
FIGS. 1*a* and 1*b* respectively are side elevational views of a conventional household ironing board shown in the work position and in the rest position.
Figure 1B:
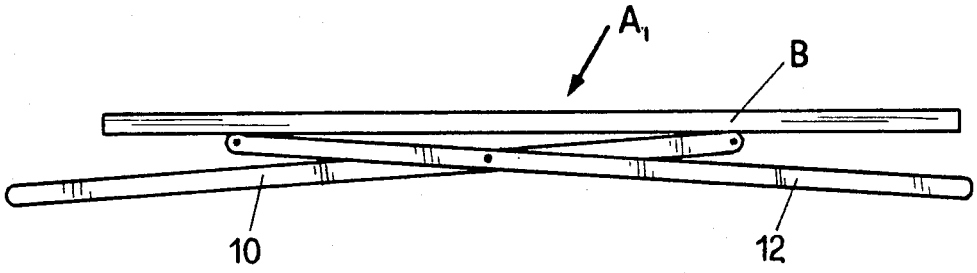
FIG.1b PRIOR ART

Referring now to the drawings and first to FIGS. 1*a* and 1*b*, a conventional household ironing board A (diagrammatically shown) includes an ironing top B and a folding support formed by legs 10, 12 which are pivotally mounted about center pins 14 and end pins 16, 18 so that, as usual, the ironing board can take the work position A and the rest position $A_1$. When the ironing board is in the rest position $A_1$ it occupies a minimum space so that it can be put away and stored in a small space.

Figure 8:
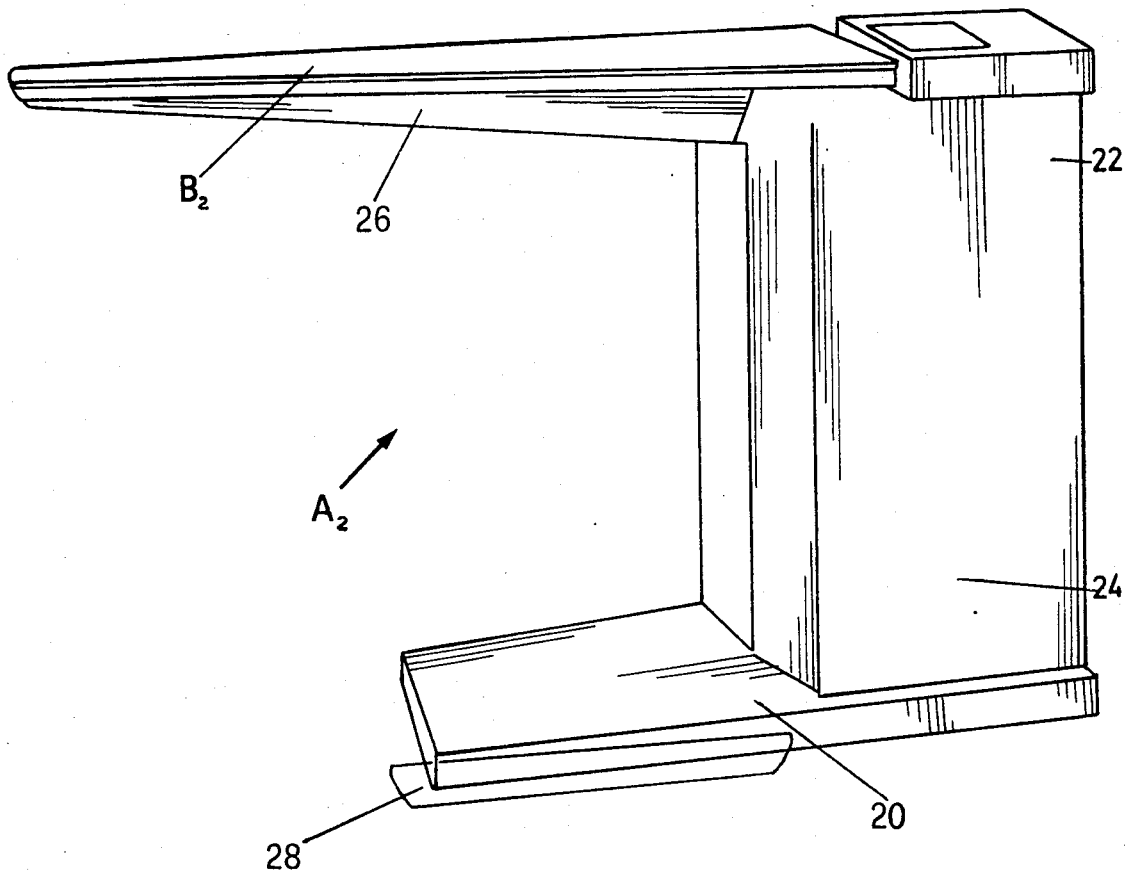
FIG. 8 PRIOR ART
FIG. 8 is a perspective view of an industrial or commercial steam ironing machine for dry cleaning shops and laundries.

Referring now to FIG. 8, there is shown an industrial ironing machine $A_2$ intended to be used in laundries and dry cleaning shops, and which has a rigid structure of relatively great overall dimensions comprised of a base platform 20 from which extends a box-type upright 22, at the upper end 24 of which is an ironing top $B_2$ provided with a suction chamber 26. Embodied in the upright 22 is a steam generator for feeding steam to the steam iron as well as an aspirator for drying the clothes. The reference 28 designates a control pedal of the machine $A_2$.

It is clear that, because of the weight, the dimensions and the rigidity of ironing machine $A_2$, it can be used only in industrial applications, in rooms of a certain capacity and as a fixed installation.

FIGS. 2–6 show the steam ironing appliance according to this invention.

The steam ironing appliance C comprises a base 30, which preferably is formed of metal tubes, and from which extends a supporting column D suitably fixed to the base. Column D is provided at the lower end thereof with a plate 32 for connection to the base 30 and at the upper end thereof with a bracket 34 for connecting an ironing board F which is suitably secured to the column D such that the ironing board F can take two main positions, namely the rest position C shown in FIG. 2 and the work position $C_1$ shown in FIG. 3. In the rest position of FIG. 2, the ironing board F extends in a substantially vertical plane, whereas in the work position of FIG. 3 it extends in a substantially horizontal plane.

The ironing board F is suitably formed so as to have a lower suction chamber G which, on the one hand, is in communication with the atmosphere through a plurality of holes (not shown) provided in the ironing top 36, and on the other hand is in communication with a tangential inlet 38 of a centrifugal aspirator 40, the outlet of which is axially directed so that discharge therefrom occurs in the direction of arrow X. An electric motor 42 drives the rotor of the aspirator 40.

Figure 2:
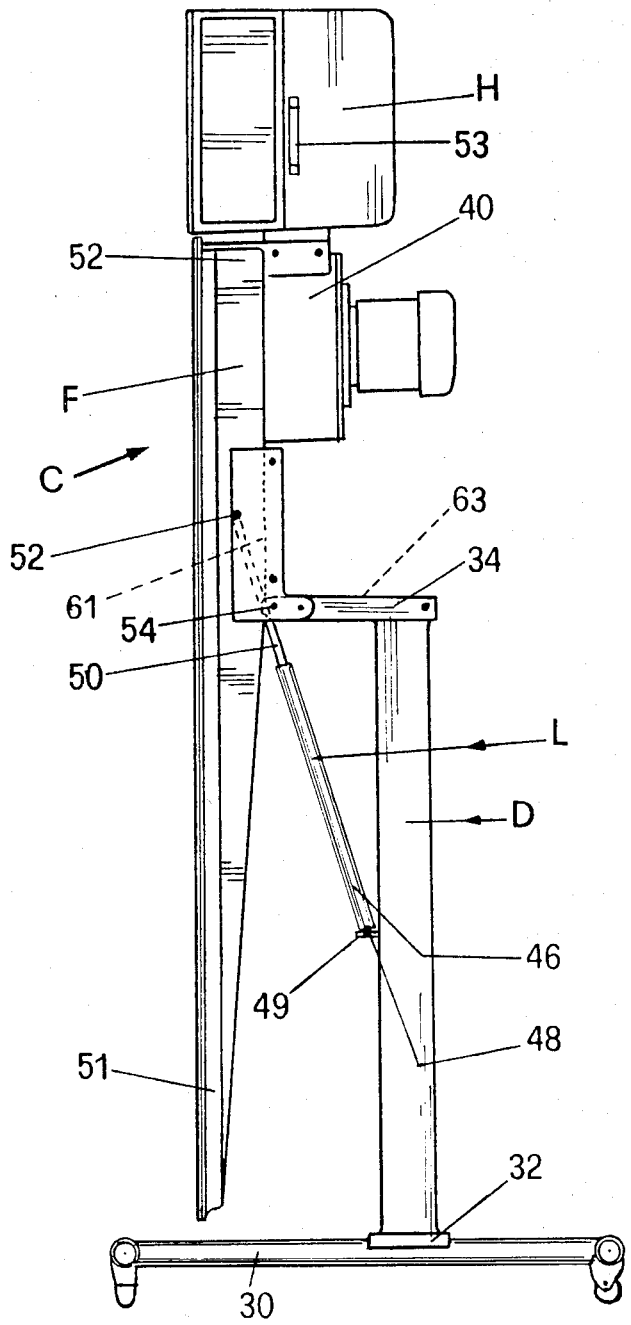
FIG. 2 is a side view of the steam ironing appliance of the invention in its rest position.
Figure 3A:
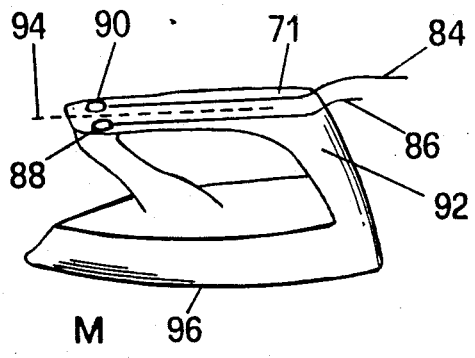
FIGS. 3*a* and 3*b* respectively are a perspective view of a steam iron forming a part of the steam ironing appliance and a side view of the steam ironing appliance in the work position.
Figure 3B:
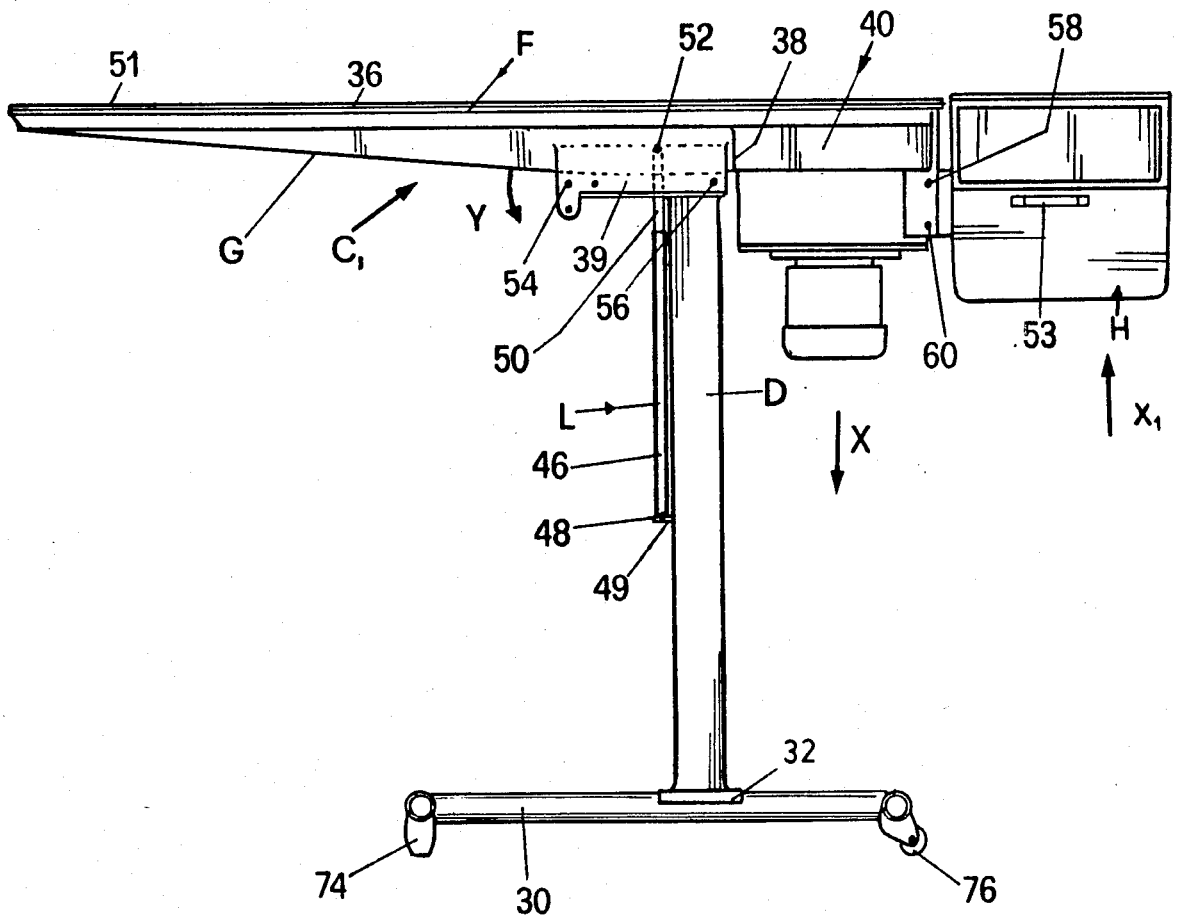

A steam generator H is connected to the ironing board F in such a manner that, when the ironing board is fully assembled, it presents the structure indicated in FIGS. 2 and 3, ironing board F being so dimensioned as to obtain a good ironing action and to have a relatively low weight, for example of about 30 kg.

A pair of shock absorbers L, e.g. gas springs, extend parallel to each other, but only one shock absorber can be seen in FIGS. 2 and 3. Each of the two shock absorbers L is formed of a cylinder 46 and a piston rod 50, cooperating with fluid contained in the cylinder. The lower end of each cylinder 46 is hinged at 48 to the column D through a plate 49 fastened thereto, while each piston rod 50 is hinged at 52 to the ironing board F. When the ironing board F is in a horizontal position, the shock absorbers L extend parallel to the column D, while when the ironing board F is in a vertical or rest position, with its tip 51 lowered, the shock absorbers L are suitably inclined with respect to the column D.

The presence and the function of the shock absorbers L are important because of the characteristic structure of the appliance which provides a weight unbalance with respect to a hinge 54 which pivotally connects the ironing board F to the column D in order that the appliance can take the rest position of FIG. 2 presenting the minimum overall dimensions and the work position of FIG. 3 presenting the maximum overall dimensions.

When the ironing appliance is in the work position with the ironing board F horizontally disposed, the weight is unbalanced to the right hand side as shown in FIG. 3, and therefore in order to rotate the ironing board F about the hinge 54 to bring it to its vertical position it would be necessary to exert a very high force in the absence of the gas springs L. With the presence of these springs, on the contrary, the force exerted by the operator to rotate the ironing board F in the counterclockwise direction of arrow Y to bring the ironing board F from the horizontal position to the vertical position one is reduced to a minimum, since it is sufficient for the operator simply to apply finger pressure to a handle 53 in the direction of arrow X1 to lift the relative heavy portion of the ironing board F by rotating it about the hinge 54, this rotation being promoted by the gas springs L.

On the contrary, when the ironing board F is to be brought from its vertical position to the horizontal position of FIG. 3, the gas springs L operate in an opposite direction, by acting as shock absorbers and preventing the clockwise rotation to occur suddenly and therefore to cause collisions between the appliance components and possible failure thereof or injuries to the operator.

In accordance with the structure of the ironing appliance and the relative arrangement of steam generator H and aspirator 40, the ironing board F rotates to a vertical position with tip 51 directed downwardly. Rotation to the vertical position in an opposite direction would not be possible since the components H and 40 would interfere with the supporting column D.

In order to assemble or disassemble the steam ironing appliance C, four pins only are necessary, namely a pin for hinging the ironing board F to the column D, a pin for securing the ironing board to the column D in the work position, and two pins for securing the steam generator to the ironing board through the aspirator casing. These pins are indicated at 54, 56, 58, 60. Four screws indicated at 62, 64, 66, 68 in FIG. 5 secure the column D to the base 30 through the plate 32 of the column D and a plate 72 of the base 30.

The ironing board F may be arranged to rotate in a horizontal plane with respect to the base 30, either by rotatably mounting the assembly D, F about the base, or by rotatably mounting the ironing board F only about the column D which is fixed with respect to the base.

The base is advantageously provided with two rubber feet 74 or the like and two pivotable rollers 76 for the easy displacement of the appliance.

Figure 4:
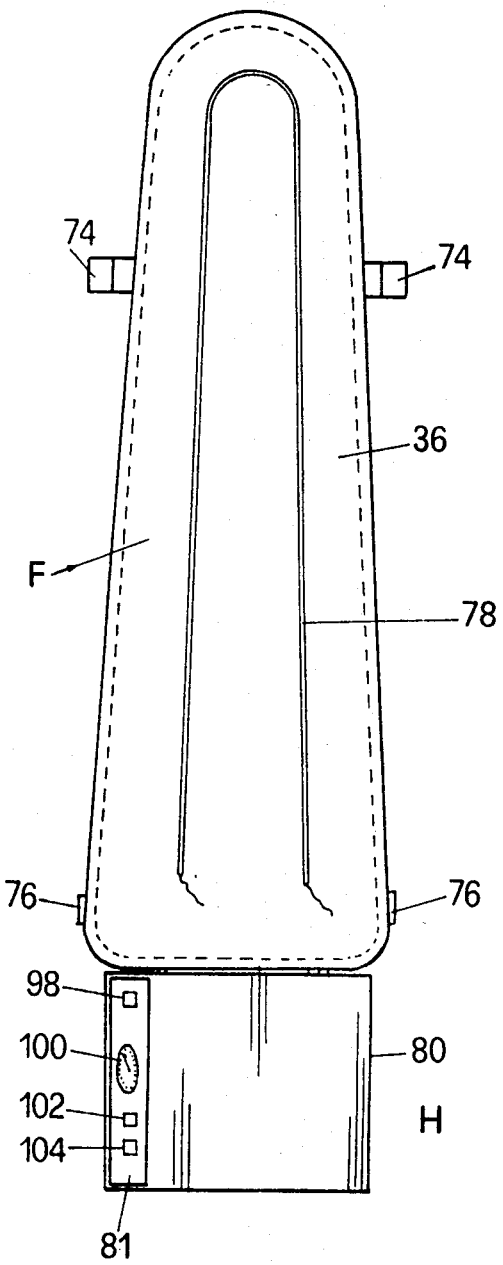
FIG. 4 is a top plan view of the steam ironing appliance.

In FIG. 4, a resistor 78 is arranged below the work top 36 of the board F to heat a cover or felt covering the perforated work top 36 and to prevent items being ironed from being wetted by the felt. The steam generator H is contained in a box 80 capable of allowing support on its upper surface of a steam iron M. Box 80 contains a heating resistor, a pressure switch, a safety valve, an electric circuit for controlling the steam iron, the ironing board, the aspirator and the steam generator as well as an electronic circuit for controlling the steam iron M and the steam delivery and the suction functions. The latter circuit includes leads 84 and 86 contained in the steam iron handgrip in such a manner as to be connected to a pair of sensors 88, 90 placed in the front of a handle 92 at equal distances from the center line 94 of the handle, these sensors being able to be alternately or simultaneously energized simply by being touched by the operator to control either steam delivery through a perforated plate 96 of the steam iron M (the perforations are not shown) or air suction through the perforations of the ironing top 36, the chamber G, the aspirator inlet 40 and the aspirator outlet, or simultaneously both such steam delivery and air suction.

Elements 98, 100, 102, 104 designate indicators of the instruments controlling the operation of the ironing appliance.

Figure 5:
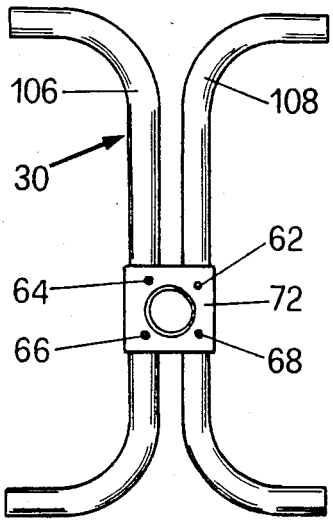
FIG. 5 is a top plan view of the base only.

The base 30 of the ironing appliance C is formed of metal tubes, in this case C-shaped tubes 106, 108, shown in FIG. 5, connected to each other by means of the plate 72 asymmetrically arranged with respect to the transverse center line of the base, for the sake of stability. Of course, the base 30 can be formed in any other suitable manner ensuring stability and also greater east of transport of the ironing appliance.

Figure 7:
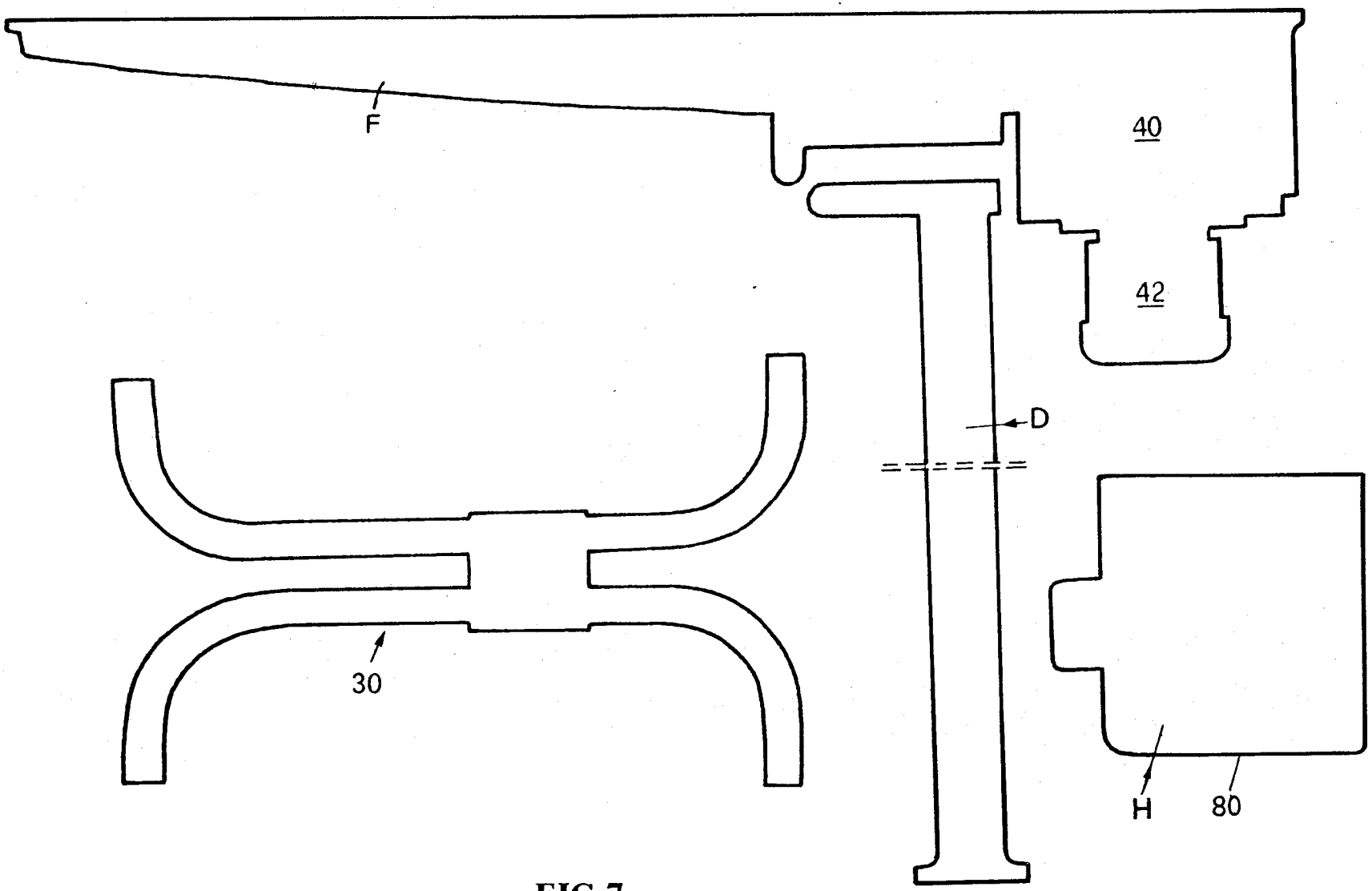
FIG. 7 is a diagrammatic view of the four main components of the steam ironing appliance, with the exception of the steam iron, in their disassembled condition for storage or transport.

Referring now to FIG. 7, there are diagrammatically shown the four main components of the ironing appliance according to the invention, namely the ironing board F including the centrifugal aspirator 40 with electric motor 42 fastened thereto, the column D, the base 30 and the box 80 containing the steam generator H.

The capability of the machine to be immediately disassembled and reassembled from the four components thereof by means of the above-mentioned pins and screws is a basic condition for transport and storage of the ironing appliance. For transport by truck, railway, aircraft or ship, it is sufficient for the four components of FIG. 7 to be placed in a container of limited dimensions, thus being valid also for the storage of disassembled ironing appliances in relatively reduced spaces.

In such a container, the ironing appliance could be placed in the attitude of FIG. 2, but without the elements L and possibly the steam generator H. In fact, a device already used by the operator or a boiler feeding a plurality of ironing machines could be employed for steam generation.

Figure 6:
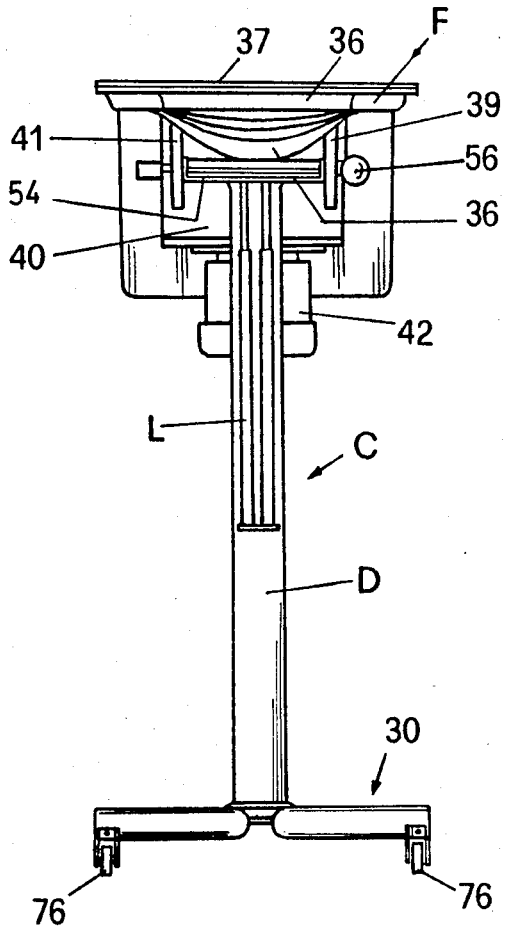
FIG. 6 is a front view of the steam ironing appliance seen from the side opposite the aspirator side.

In FIG. 6 there is shown the manner of hinging of the ironing board F, having the work top 36 covered by a felt 37, to the column D. Pivot pin 54 pivotally connects by ironing board F to the column by being inserted into holes in vertical brackets 39, 41 of the board F and into corresponding holes in column D. Safety pin 56 locks the ironing board in the work position with respect to the column D.

Having so described the ironing appliance C the operation and the advantages thereof will be apparent and are summarized in the following.

Assuming that assembly of the appliance must be performed starting from the four components shown in FIG. 7, the first step is to secure the column D to the base 30 by means of the screws 62, 64, 66, 68. Then, the ironing board F will be hinged to the column D by means of the pivot pin 54, and then the ironing board F will be secured by inserting the pin 56 into the corresponding holes of board and column. At this point the ironing board is fastened to the elements 30 and D. Then, the box 80 will be secured by means of the screws 58–60 to the aspirator 40 and the ironing board F, so as to have an assembly comprised of the steam generator, the aspirator and the ironing board. Then, the side shock absorbers L will be connected to the ironing appliance C by means of the pivot pins 48, 52. The steam iron M will be connected to the steam generator through a hose, whereas the electronic circuit 84, 86, 88, 90 will be connected to the respective components under control.

Once the ironing appliance C is mounted as illustrated in FIG. 3 and the steam generator H is filled with a relatively small water amount, the appliance is ready to operate as an industrial ironing machine while having the dimensions and other features of a simple home ironing appliance. Simultaneously with or after steam ironing by means of the steam iron, a suction operation by means of the aspirator 40, 42 occurs. This causes residual moisture in the ironed clothes to be removed, thereby drying them. The aspirator power can be set so as to produce a good adhesion of the clothes on the ironing top 36 covered by the felt. These steps can be controlled by the operator through the sensors 88, 90 in the steam iron M.

When the operator has completed use of the appliance, it is moved from the work position to the rest position of FIG. 2. It is sufficient to remove the safety pin 56 and then to exert by hand a small force of the handle 53 of the ironing board F in the direction of the arrow $x_1$ to obtain pivotal movement of the ironing board F in the direction of the arrow Y about the pivot pin 54. The ironing board will then rotate in a counterclockwise direction as viewed in FIGS. 2 and 3 (and the rotation will be facilitated by the shock absorbers L), until it is in the substantially vertical position $C_1$ of FIG. 2, where it can be locked. In this compact attitude, the ironing appliance C can be moved by means of the rollers 75 and placed in a small storeroom or the like, as in the case of conventional ironing boards with folding legs, as illustrated in FIG. 1. In this manner there is no need of a large space for storage of the ironing appliance. In the rest position of FIG. 2, the ironing appliance can be placed in a conventional closet of a kitchen.

When the ironing board F is to be brought again from the vertical rest position of FIG. 2 to the horizontal work position of FIG. 3, the operator must operate on the ironing board in a reverse direction with respect of that of arrow Y, causing the ironing board to be rotated in a clockwise direction as viewed in FIGS. 2 and 3 about the pivot pin 54. Because of the weight distribution along the ironing board F, the latter will tend to fall by gravity from the vertical position of FIG. 2 to the horizontal position of FIG. 3 until the stop plane 61 of the ironing board F is aligned with the stop plane 63 of the column D. This must be avoided for reasons of safety of the machine and of the operator. The hydraulic resistance of the shock absorbers L which are shortening by passing from the expanded condition of FIG. 2 to the retracted condition of FIG. 3 causes the clockwise rotation movement to be retarded, thereby slowing down this movement and therefore avoiding the risk of component breakage and operator injury.

Therefore the ironing appliance is very easily inclinable along all the length thereof, thereby reducing its height (1.5 m) and the occupied surface (38 cm×60 cm), which results in very small overall dimensions, for example the dimensions of a television set with associated support. The horizontal surface occupied by the appliance in the rest position is reduced by 60% of that occupied in the work position.

The electronic control means of sensors 88, 90 excludes any type of pedal 28 usually employed in industrial or commercial ironing machines.

The anatomic handgrip 71 of the steam iron M permits the use thereof without tiring the wrist of the operator. This handgrip is formed of a thermoinsulating material, while the pair of sensors 88, 90 have the form of hemispherical heads. The electronic circuit extending from the sensors 88, 90 is contained partially in the handle 71 and partially in the box of the steam generator H and the electric board 81.

The electronic circuit of conventional design is an important feature of this invention, since all conventional ironing boards include in the steam iron M a microswitch controlling an electric steam valve while suction is controlled by a pedal, the operation of which is not always easy and causes the operator to be compelled to work often in an awkward position.

The centrifugal aspirator 40 performs, at relatively low power, perfect suction and therefore drying of the ironed clothes.

It should be understood that the construction details can be changed without departing from the scope of the invention.

Briefly stated, the invention relates to disassemblable ironing board which can be reclined by means of hinge elements, which is heated and provided with suction in different areas by means of a centrifugal aspirator controlled by electronic sensors.

The steam generator is self-contained and provided with a dry resistor equipped with a pressure switch, a thermostat and a safety valve.

What is claimed is:

1. A steam ironing machine comprising:

a support member;

an ironing board having first and second ends; a steam iron for cooperation with said ironing board to iron a cloth article and connected to a source of steam for applying steam to the cloth article;

suction means mounted on said first end of said ironing board for connection to means at said ironing board for removing residual moisture from the cloth article;

hinge means for pivotally mounting said ironing board, at a position thereof between said first and second ends thereof, to said support member for pivotal movement with respect thereto between a work position, whereat said ironing board extends horizontally, and a rest position, whereat said ironing board extends vertically with said second end thereof directed downwardly; and shock absorber means for controlling movement of said ironing board in opposite directions between said work and rest positions and for absorbing stresses resulting from said movement, said shock absorber means comprising a pair of parallel shock absorbers, each said shock absorber including a cylinder having a lower end pivoted to said support member, and a piston rod movable into and out of said cylinder and having an upper end pivoted to said ironing board, said shock absorbers being located on a side of said support member directed toward said second end of said ironing board, said shock absorbers extending substantially parallel to said support member when said ironing board is in said work position thereof, and said shock absorbers being inclined to said support member when said ironing board is in said rest position thereof.

2. A machine as claimed in claim 1, wherein said support element comprises a vertical column, and further comprising a base supporting said column.

3. A machine as claimed in claim 2, wherein said hinge means comprises a pin extending through respective members mounted on said ironing board and said column.

4. A machine as claimed in claim 3, wherein said members mounted on said ironing board and said column respectively comprise brackets on the bottom of said ironing board and on the top of said column, said pin extending through openings in said brackets.

5. A machine as claimed in claim 4, wherein said pin is removable, and wherein said base is removable from said column.

6. A machine as claimed in claim 2, further comprising rollers on said base.

7. A machine as claimed in claim 2, wherein said column is mounted asymmetrically on said base.

8. A machine as claimed in claim 1, wherein said suction means at said ironing board comprises a chamber beneath said ironing board and perforations through the top of said ironing board.

9. A machine as claimed in claim 8, wherein said suction means comprises a suction pump.

10. A machine as claimed in claim 1, further comprising a steam generator removably connected to said first end of said ironing board, said steam generator being connected to said steam iron.

11. A machine as claimed in claim 1, further comprising hand operated means on said steam iron for controlling operation of the source of steam and said suction means.

* * * * *